US006119797A

United States Patent [19]

Hong et al.

[11] Patent Number: 6,119,797

[45] Date of Patent: Sep. 19, 2000

[54] SINGLE CONE EARTH BORING BIT

[75] Inventors: Chunling Hong; Xuezhong Liu; Hongmei Huang; Heng Du, all of Hubei, China

[73] Assignee: Kingdream Public Ltd. Co., Huebi, China

[21] Appl. No.: 09/173,576

[22] Filed: Oct. 15, 1998

[30] Foreign Application Priority Data

Mar. 19, 1998 [CN] China ..... 98235440

[51] Int. Cl.[7] ..... E21B 10/14; E21B 10/16; E21B 10/50

[52] U.S. Cl. ..... 175/336; 175/365; 175/399; 175/408

[58] Field of Search ..... 175/365, 408, 175/406, 336, 399, 323, 325.1, 325.2, 325.3, 325.4

[56] References Cited

U.S. PATENT DOCUMENTS

| | | | |
|---|---|---|---|
| 4,471,845 | 9/1984 | Jürgens | 175/329 |
| 4,726,718 | 2/1988 | Meskin et al. | 408/145 |
| 4,790,397 | 12/1988 | Kaalstad et al. | 175/365 |
| 4,913,244 | 4/1990 | Trujillo | 175/65 |
| 4,936,398 | 6/1990 | Auty et al. | 175/336 |
| 4,976,324 | 12/1990 | Tibbitts | 175/329 |
| 5,074,367 | 12/1991 | Estes | 175/374 |
| 5,154,245 | 10/1992 | Waldenström et al. . | |
| 5,180,021 | 1/1993 | Champion et al. | 175/76 |
| 5,415,243 | 5/1995 | Lyon et al. | 175/331 |
| 5,505,273 | 4/1996 | Azar et al. . | |
| 5,651,421 | 7/1997 | Newton et al. | 175/431 |
| 5,655,612 | 8/1997 | Grimes et al. | 175/401 |
| 5,803,194 | 9/1998 | Rowlett | 175/325.2 |
| 5,890,550 | 4/1999 | Swadi et al. | 175/374 |

FOREIGN PATENT DOCUMENTS

| | | |
|---|---|---|
| 89105773 | 4/1991 | China . |
| 93104748 | 11/1993 | China . |
| 0 044 817 A3 | 1/1982 | European Pat. Off. . |
| 0 501 258 A1 | 9/1992 | European Pat. Off. . |

*Primary Examiner*—George Suchfield
*Attorney, Agent, or Firm*—Seed IP Law Group

[57] ABSTRACT

The invention discloses a single cone earth boring bit which is adapted to be used for boring in oil fields, mining and geological prospecting. The single cone earth boring bit is composed of a bit body (1), gauge blocks (2), active cutting gauge teeth (4), passive gauge teeth (3) and knobby cone (6) etc. On the knobby cone (6), there are inserted wear-resistant teeth intermittently or successively, so as to make the wear resistance of the bit cutting system to be matched with the service life of the bearing. At the same time, gauge blocks (2) are provided on the bit body which may be directly made on or welded to the bit body. On the gauge blocks (2), there are inserted common carbide or wear-resistant active cutting gauge teeth (4) and the passive gauge teeth (3) to enhance the gauge-protecting effect of the bit. Such a single cone earth boring bit can significantly increase the footage of the bit and reduce the cost for drilling.

17 Claims, 2 Drawing Sheets

*cross-section B-B*

SINGLE CONE EARTH BORING BIT

The invention relates to a single cone earth boring bit used for boring in oil fields, mining and geological prospecting.

BACKGROUND OF THE INVENTION

At present the single cone earth boring bit used for boring in oil fields, mining and geological prospecting is composed of a bit body, knobby cones, teeth, sealing members and a lubricating system etc. The teeth and the knobby cone are joined together in form of interference fit. The material for all the teeth are the same, such as hard metal alloy. But owing to the fact that wear of the teeth is not uniform during working of the bits, the teeth in the zone (the permanent contact zone) that contacts constantly with the bottom of a well are worn off so quickly that the working life of the teeth of a boring bit is not matched with that of the bearing, thus affecting the footage of the earth boring bit. Furthermore, as the teeth are worn out, the bit body is likely to be worn subsequently with its diameter being reduced, this would make trouble on further boring after the bit body has been raised.

The object of the invention is to provide a single cone earth boring bit with wear-resistant teeth and bit body gauge blocks which carries active cutting gauge teeth and passive gauge teeth so as to enhance the working life of the teeth and the gauge-protecting effect of the earth boring bit, thereby to improve its footage.

SUMMARY OF THE INVENTION

In order to fulfill the above object, according to the present invention a single cone earth boring bit is provided, which comprising a bit body, a knobby cone, teeth, sealing members and a lubricating system; the teeth joined together the bit in the form of interference fit, the wear-resistant teeth arranged successively or intermittently on the cone of the bit, gauge blocks arranged on the bit body, the active cutting gauge teeth and the passive gauge teeth disposed on the gauge blocks.

According to the invention, wear-resistant teeth are arranged successively or intermittently on the tooth rows of the cone in the permanent contact zone and the intermittent contact zone. The wear-resistant teeth comprise poly-crystalline diamond carbide composite teeth. The wear-resistant teeth comprise a perfect diamond sintered body. The gauge blocks of the bit body are made directly in the bit body, and the number of the gauge blocks is 2~5. The gauge blocks of the bit body can be machined individually, then welded directly to the bit body. On the gauge blocks of the bit body the common carbide alloy or the wear-resistant active cutting gauge teeth and the passive gauge teeth are arranged. The angle $\alpha$ between the axis of an active cutting gauge tooth and the tangential direction of the gauge blocks of the bit body is in the range from 0~90°. The protruded height H of the active cutting gauge teeth is 2~20 mm. The protruded height L of the passive gauge teeth is less than the protruded height H of the active cutting gauge teeth. The wear-resistant active cutting gauge teeth and the passive gauge teeth are poly-cryotalline diamond carbide composite teeth and are arranged successively or intermittently. The wear-resistant active cutting gauge teeth and the passive gauge teeth are a perfect diamond sintered body.

The invention is accomplished by the following technical solution: 1. On the teeth-disposed surfaces located at the permanent contact zone of a cone with which a single cone earth boring bit contacts constantly with the bottom of a well, a lot of wear-resistant teeth are arranged intermittently or successively, thus increasing the wear-resistance of the part of the bit which is liable to be worn thereby to enhance the service life of the bit; 2. A double gauge protecting effect is achieved by following means on a single cone earth boring bit. Gauge tooth rows in which wear-resistant teeth are arranged intermittently or successively are provided in the intermittent contact zone with which the cone contacts intermittently with the bottom of a well to serve as primary gauge protection. The gauge blocks are provided additionally on the bit body. The common or wear-resistant active cutting gauge teeth and the passive gauge teeth are arranged on the gauge blocks intermittently or successively to serve as second gauge protection.

The above-mentioned solution can effectively solve the problems, i.e. the teeth of the single cone earth boring bit is liable to be worn and the gauge protection is liable to be ineffective. As adequately increasing the cost of a bit, it is possible to significantly enhance the service and the operational effect of the bit, and to greatly reduce the overall coat of the drilling.

Now the invention will be described further in detail by reference with the appended drawings and embodiments.

Figure 1:
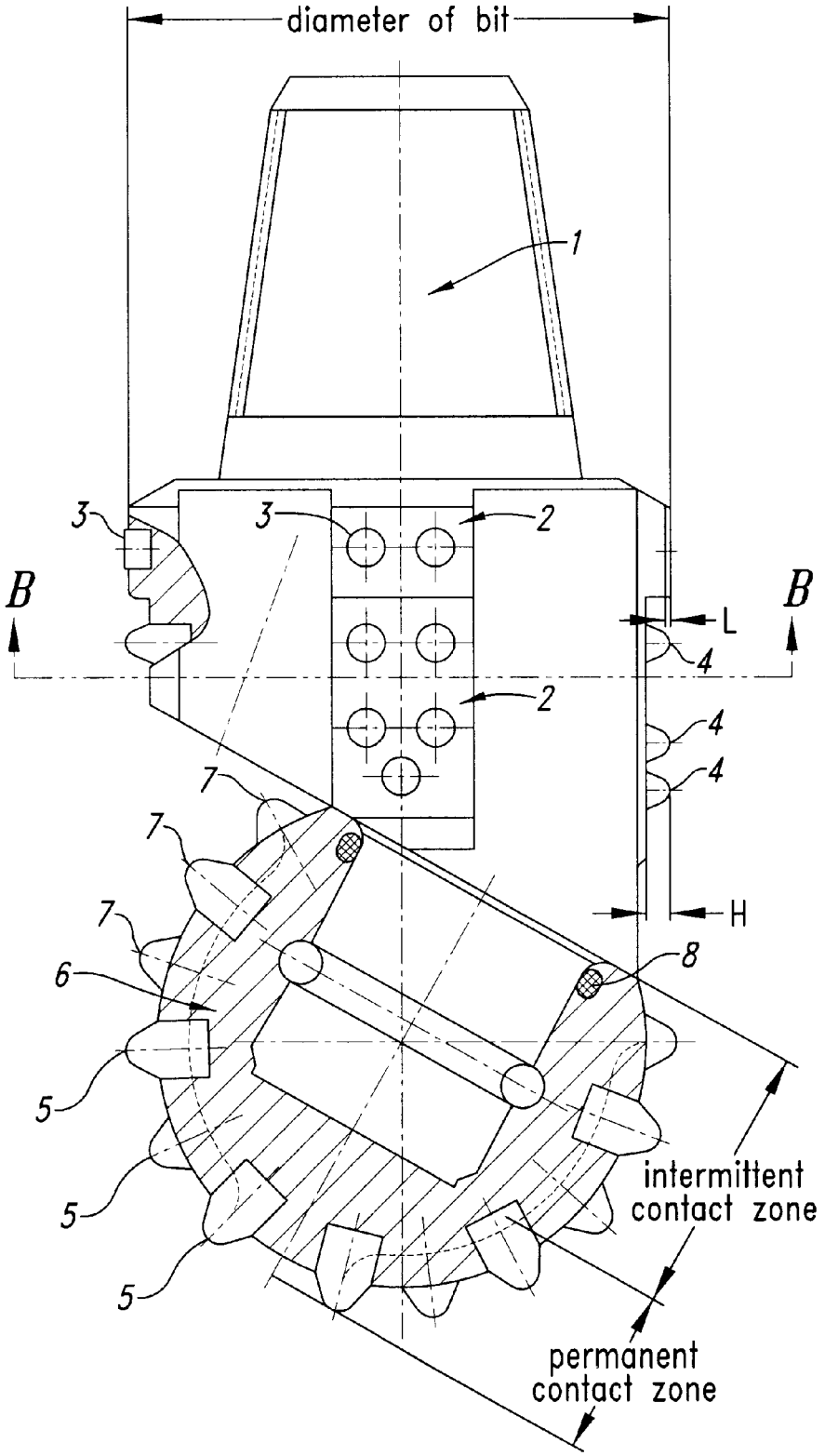
FIG. 1 is a schematic view of the structure of an embodiment according to the invention.

In the drawings: 1-bit body, 2-gauge block; 3-passive gauge teeth; 4-active cutting gauge teeth; 5-tooth rows in the permanent contact zone with which the knobby cone contacts constantly with the bottom of a well; 6-knobby cone; 8-sealing member; 7-tooth rows in the intermittent contact zone with which the knobby cone constantly with the bottom of a well.

BRIEF DESCRIPTION OF THE INVENTION

Figure 2:
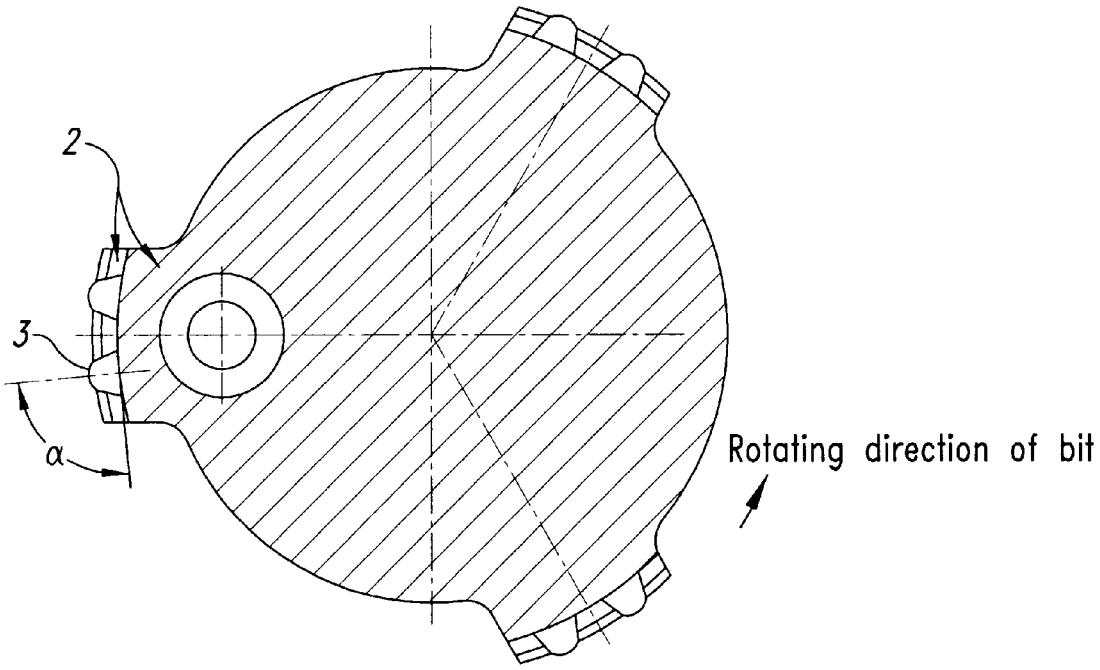
FIG. 2 is a schematic view of cross section B—B of the bit body.

As shown in FIGS. 1 and 2, on knobby cone 6 two kinds (i.e. common carbide teeth or wear-resistant) of teeth are respectively distributed in the form of interference fit in tooth rows 5 provided in the permanent contact zone with which the knobby cone contacts constantly with the bottom of a well and in tooth rows 7 provided in the intermittent contact zone with which the knobby cone contacts intermittently with the bottom of a well. In this embodiment, wear-resistant teeth are successively inserted in tooth rows 5 in the permanent contact zone so as to enhance the wear resistant of the cutting system. The wear-resistant teeth may be cone-spheroid ploycrystalline diamond carbide alloy composite teeth, teeth inserted diamond sintered block, or a perfect diamond sintered body. The teeth in tooth rows 7 of the intermittent contact zone on the knobby cone alternatively contact with the bottom of the well, having the gauge-protecting effect. The wear-resistant teeth are intermittently arranged on these tooth rows to enhance the gauge-protecting function of the cone and to function as the primary gauge protection. Gauge blocks 2 can be directly machined in or welded to the bit body 1. Gauge block 2 can be provided 2~5 pieces depending on the size of the bit, in this embodiment it is 3 in number. Passive gauge teeth 3 and active cutting gauge teeth 4 are inserted in the gauge blocks 2 and function as the second gauge protection. According to the hardness of the earth's formation where the bit is to be used, the angle $\alpha$ between the axis of an active cutting gauge tooth and the tangent line of its gauge block can be selected in the range of 0~90°. In the embodiment, α is equal to 90°. The protruded height H of the active cutting gauge teeth 4 can be selected from 2~20 mm, in this embodiment, H is 6 mm. The active cutting gauge teeth are provided in order to reduce the resistance during drilling. The protruded height L of the passive gauge teeth 3 on the gauge blocks 2 is less than the protruded height H of the active cutting gauge teeth 4, so as to prevent the bit from the failure of its gauge-protecting effect when the active cutting gauge teeth have been broken. In this embodiment, L is 1.7 mm. The passive gauge teeth can be made of common carbide alloy or wear-resistant teeth arranged intermittently or successively, such as flat crest poly-crystalline diamond carbide alloy composite teeth, teeth inserted diamond sintered block, or a perfect diamond sintered body. The active cutting gauge teeth 4 can be made of common carbide alloy, or wear-resistant teeth arranged intermittently or successively, such as cone-sphenoid poly-cytosine diamond carbide composite teeth, teeth inserted diamond sintered block, or a perfect diamond sintered body.

What is claimed is:

1. A single cone earth boring bit for boring a hole having a substantially cylindrical wall and a substantially semi-spherical bottom, the boring bit comprising a bit body; a knobby cone; a plurality of wear-resistant teeth; at least one sealing member; the wear-resistant teeth joined to the bit in the form of interference fit, the wear-resistant teeth being distributed in a first tooth row provided in a permanent contact zone at which the knobby cone contacts constantly with the bottom of the hole and in a second tooth row provided in an intermittent contact zone at which the knobby cone contacts intermittently with the bottom of the hole; a plurality of gauge blocks arranged on the bit body; and a plurality of wear-resistant active cutting gauge teeth and a plurality of wear-resistant passive gauge teeth disposed on the gauge blocks in an alignment configured to contact only the wall of the hole.

2. A single cone earth boring bit according to claim 1, wherein the wear-resistant teeth are arranged successively on the first and second tooth rows of the knobby cone in the permanent contact zone and the intermittent contact zone, respectively.

3. A single cone earth boring bit according to claim 1, wherein the gauge blocks of the bit body are made directly in the bit body, and the number of the gauge blocks is 2~5.

4. A single cone earth boring bit according to claim 1, wherein the gauge blocks of the bit body can be machined individually, then welded directly to the bit body.

5. A single cone earth boring bit according to claim 1, wherein the wear-resistant active cutting gauge teeth and the wear-resistant passive cutting gauge teeth are arranged on the gauge blocks of the bit body.

6. A single cone earth boring bit according to claim 5, wherein the angle α between the axis of an active cutting gauge tooth and the tangential direction of the gauge blocks of the bit body is in the range from 0~90°.

7. A single cone earth boring bit according to claim 5, wherein the protruded height H of the active cutting gauge teeth is 2~20 mm.

8. A single cone earth boring bit according to claim 5, wherein the protruded height L of the passive gauge teeth is less than the protruded height H of the active cutting gauge teeth.

9. A single cone earth boring bit according to claim 5, wherein the wear-resistant active cutting gauge teeth and the wear-resistant passive cutting gauge teeth are successively arranged.

10. A single cone earth boring bit according to claim 5, wherein the teeth provided on the gauge blocks of the bit body comprise a pure diamond sintered body.

11. A single cone earth boring bit according to claim 1, wherein the wear-resistant teeth are arranged intermittently on the first and second tooth rows of the knobby cone in the permanent contact zone and the intermittent contact zone, respectively.

12. A single cone earth boring bit according to claims 2 or 11, wherein wear-resistant teeth comprise poly-crystalline diamond carbide composite teeth.

13. A single cone earth boring bit according to claims 2 or 11, wherein the wear-resistant teeth comprise a pure diamond sintered body.

14. A single cone earth boring bit according to claim 1, wherein the active cutting gauge teeth made of common carbide alloy and the passive cutting gauge teeth made of common carbide alloy are arranged on the gauge blocks of the bit body.

15. A single cone earth boring bit according to claim 5, wherein the teeth provided on the gauge blocks of the bit body comprise poly-crystalline diamond carbide composite teeth.

16. A single cone earth boring bit for creating a hole having a generally cylindrical wall and a bottom portion, the boring bit comprising:

a bit body having a plurality of gauge blocks thereon;

a plurality of gauge teeth disposed on the gauge blocks, a knobby cone rotatably coupled to the bit body, the knobby cone having a permanent portion aligned to be in constant contact with the bottom portion of the hole while the knobby cone rotates during operation, and an intermittent portion aligned to be in intermittent contact with the bottom portion of the hole while the knobby cone rotates during operation;

a plurality of wear-resistant teeth, the wear-resistant teeth being arranged on the knobby cone in a plurality of tooth rows, a first tooth row being located in the permanent contact zone of the knobby cone, and a second tooth row being located in the intermittent contact zone of the knobby cone; and at least one sealing member interposed between the bit body and the knobby cone.

17. The single cone earth boring bit of claim 16, wherein the gauge teeth comprise active gauge teeth and passive gauge teeth.

* * * * *